United States Patent [19]

Bottenbruch

[11] 4,216,709

[45] Aug. 12, 1980

[54] CHIMNEY

[75] Inventor: Hermann Bottenbruch, Düsseldorf, Fed. Rep. of Germany

[73] Assignee: Karrena GmbH, Düsseldorf, Fed. Rep. of Germany

[21] Appl. No.: 972,714

[22] Filed: Dec. 14, 1978

[30] Foreign Application Priority Data

Sep. 23, 1978 [DE] Fed. Rep. of Germany ..... 2841570

[51] Int. Cl.[2] ..... E04F 17/02; F23L 17/02

[52] U.S. Cl. ..... 98/58; 52/249; 110/184

[58] Field of Search ..... 98/58; 52/244, 249, 52/192; 110/184; 126/120; 114/187

[56] References Cited

U.S. PATENT DOCUMENTS

| | | | |
|---|---|---|---|
| 859,616 | 7/1907 | Repetto | 98/58 |
| 3,320,969 | 5/1967 | Gordon | 52/249 |
| 3,367,075 | 2/1968 | Pierce et al. | 52/249 |
| 3,566,768 | 3/1971 | Walpole, Jr. | 98/58 |
| 3,727,566 | 4/1973 | Roy | 110/184 |
| 3,952,531 | 4/1976 | Turner | 62/45 |

FOREIGN PATENT DOCUMENTS

| | | | |
|---|---|---|---|
| 857865 | 1/1953 | Fed. Rep. of Germany | 98/58 |

*Primary Examiner*—Ronald C. Capossela
*Attorney, Agent, or Firm*—Spencer & Kaye

[57] ABSTRACT

A chimney comprises an external shaft and an inner lining sub-divided into several portions arranged one above the other, each portion having an inner and an outer shell with an annular space containing compressed air therein at a higher pressure than the flue gas, each portion of the inner lining being carried by a support construction so as to be spaced from the external shaft.

13 Claims, 2 Drawing Figures

CHIMNEY

BACKGROUND OF THE INVENTION

The invention relates to a chimney. Such a chimney may have an external shaft with an inner lining which is sub-divided into several portions lying one above the other and each retained by means of a support construction which is connected to the shaft, and which leaves a free area between the shaft and the lining.

The lining of this type of chimney is generally manufactured from acid-resistant bricks which are made into a wall with acid-resistant mortar so that the best possible resistance to frequently chemically active flue gases can be achieved. Theoretically, the lining should be absolutely gas-tight so that the flue gases cannot penetrate the lining. In practice however, absolute gas-tightness of the lining cannot be guaranteed. As a result of the frequent and in many cases large temperature fluctuations during operation small cracks can arise at least after a fairly long period of operation.

In the case of fairly low flue gas temperatures there can also be the formation of a condensate. Since a crack in the lining cannot always be avoided, at least after a fairly long period of operation, condensate can thus penetrate through the lining to the exterior thereof.

It is known to form a layer of compressed air in the free area between the shaft and the lining, which layer of compressed air is at a higher pressure than the flue gas flowing upwards through the lining. With this type of layer of compressed air, it is in fact possible basically to achieve sealing off of the lining. Since the temperature of the layer of compressed air is however generally substantially lower than the flue gas temperature there is a correspondingly high temperature difference between the outside and the inside of the lining. As a result there is the danger of cracking.

SUMMARY OF THE INVENTION

It is an object of the invention to enable the sealing off of the lining with the aid of a layer of compressed air in which relatively large temperature differences do not arise between the outside and the inside of the lining.

According to the invention, there is provided a chimney comprising external shaft, an inner lining subdivided into several portions arranged one above the other and each said portion including an outer shell and an inner shell defining an annular space therebetween, a support construction connected to shaft for supporting said portions of said inner lining spaced from the shaft to define a free space between said shaft and said inner lining and air in said annular space between said outer shell and said inner shell at a higher pressure than the pressure of flue gas flowing up the chimney.

BRIEF DESCRIPTION OF THE DRAWINGS

The invention will now be described in greater detail, by way of example, with reference to the drawings, in which.

DESCRIPTION OF THE PREFERRED EMBODIMENT

Figure 1:
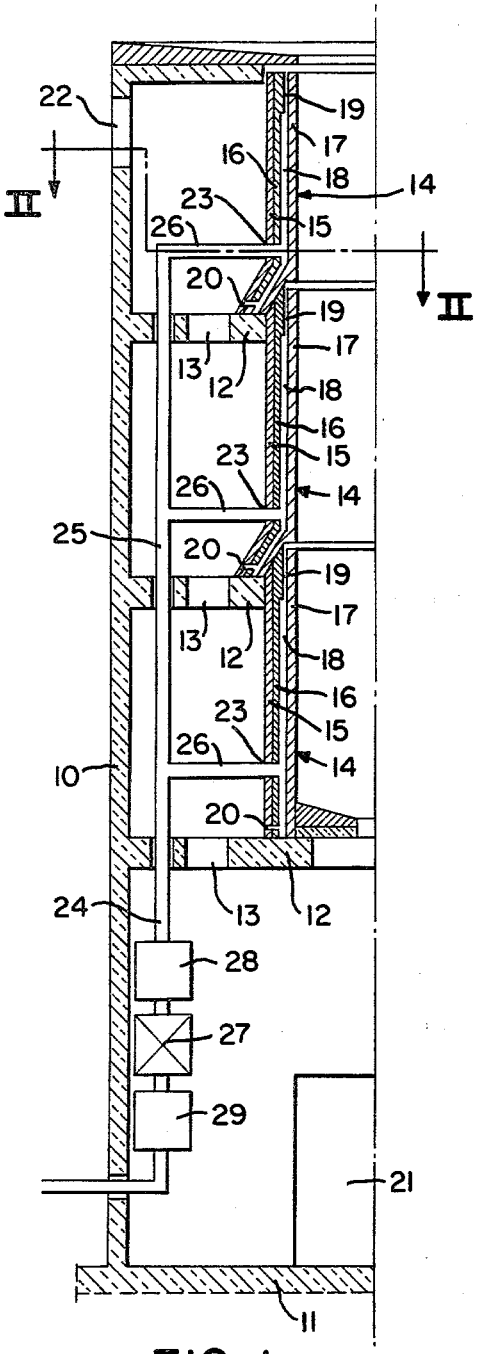
FIG. 1 shows a schematic longitudinal section through a chimney.
Figure 2:
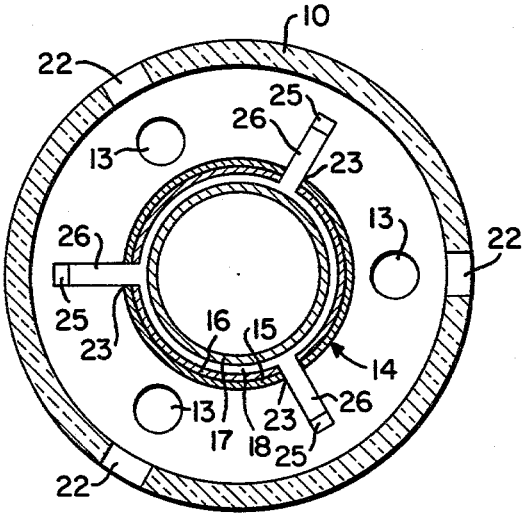
FIG. 2 shows a schematic cross-section along the line II—II in FIG. 1.

In a preferred embodiment of the invention, it is proposed in that the lining of the chimney should be subdivided into an outer shell and an inner shell and that an annular chamber formed between these shells should contain the compressed air.

On the basis of this division of the lining and on the basis of the arrangement of the layer of compressed air, there are substantially more favourable temperature ratios present and the layer of compressed air can have such a temperature that the danger of cracking due to large temperature differences is overcome. Furthermore, it is advantageous for the compressed air to be well distributed guided in the region of the lining and to have the smallest possible volume, in which at the same time good efficiency in relation to the sealing action which can be achieved is provided. In most cases it should be sufficient if the excess pressure of the layer of compressed air as compared to the pressure of the flue gas were to amount to approximately 2 mbar.

It is advantageous if the layer of compressed air is formed by a flow of compressed air, i.e. it is advantageous for an exchange of the compressed air forming the layer of air to take place in the course of the operating period. Thus it is possible that residues of flue gas or condensates which have passed through the lining despite the pressure gradient, can still be guided away.

In order to prevent too great a temperature gradient arising as compared to the temperature of the flue gas and thus possibly disadvantageous temperature loading of the lining, it is furthermore advantageous if the temperature of the compressed air is so great that the difference with respect to the temperature of the flue gas amounts, at most, to 30° C. This can be achieved by means of appropriate heating of the air used to form the layer of compressed air.

In order to distribute the compressed air as evenly as possible over the periphery of the lining, it is advantageous furthermore if each of the portions of the lining lying one above the other has several connection openings for the supply of air arranged so as to be distributed over the periphery and opening into the annular chamber.

In order to obtain a flow of air in this layer of air, the annular chamber can be provided, at least at one end, with an outlet opening. The latter is advantageously formed by means of an annular clearance, the cross-section of which is smaller than the cross-section of the annular chamber and which also acts as a throttle connected into the flow path at which throttle the air pressure can build up to the desired magnitude.

There are also other possibilities for tapping off the air leaving the layer of compressed air. It is advantageous if the compressed air passing out of the outlet opening is introduced into the flow of flue gas. This can, in preferred manner, take place in each case at the upper end of a portion of lining since the underside of the portion of lining arranged thereabove in each case usually broadens out conically in order to rest on its associated support construction at its underside.

The free chamber present between the shaft and the lining in this type of chimney can in many cases serve as a passageway so that inspection of the chimney is possible. Thus it is preferred if the connection openings serving to supply the compressed air are arranged on each portion of the lining at a height of approximately 1.5 to 2.5m above the support construction retaining the portion of lining. The lines of the air supply system leading to the connection openings can be located at an appropriate height to avoid restriction of the passageway of the support construction.

In this case, it is favourable if a smaller part of the compressed air passes out at the underside of the respective portion of lining and enters the free area formed between the shaft and the lining, while the greater part of the compressed air passes out at the upper side of the portion of lining and is introduced into the flow of flue gas. The flow of compressed air is divided into two at the height of the respective connection openings on the lining. Since a flow of air will normally prevail in the free area located between the shaft and the lining said flow of air should serve to cool the shaft, the flow of air passing out of the underside of the lining portions in each case can be introduced into this flow of air without other measures being necessary.

In order to produce the layer of compressed air, an appropriate pipe system is attached to the outlet side of a blower.

The design and dimensioning of the pipe system and of the blower should be selected so that a larger quantity of air can be conveyed than is necessary for operation of a relatively unused chimney. Fractures in the lining will probably increase in the case of a fairly long operating time without intermediate repairs. As a result of this, an even larger requirement for compressed air may occur only at a later point in time. Then it is advantageous if the pipe system and the blower are already designed for a correspondingly larger quantity of air.

Reference has already been made to the fact that it is advantageous if the air used for building up the layer of compressed air is preheated to a certain temperature and also if the excess pressure, as compared with the pressure of the flue gas, has a certain magnitude. In order to maintain these values in the required manner, on the one hand, and, on the other hand, to be able to produce the layer of compressed air with the smallest possible outlay on energy it is furthermore provided for a control circuit to be associated with the blower, the control circuit automatically predetermining the quantity of air to be conveyed depending on the temperature and pressure of the flow of flue gas.

When using this type of control it may occur even that, in the case of a sufficient draught in the chimney, therefore with a sufficiently large underpressure of flow of flue gas, normal air pressure is sufficient to achieve the sealing action so that the blower can be disconnected.

Referring now to the drawings, the chimney has an outer shaft 10 made from steel reinforced concrete which is located on to a base 11. The proportions shown in FIG. 1 are not accurate inasmuch as the chimney is substantially taller in relation to the width shown. With the construction shown, it can reach a height of several hundred meters.

Annular support plates 12 are fixed to the shaft 10 at vertical spacings of approximately 20m. The support plates 12 are provided with passages 13 which are dimensioned just to be sufficiently large for a person to climb through.

A portion of the inner lining 14 is located on to each support plate 12 whereby these portions broaden out conically in each case at their underside so that the underside can engage over the upper edge of the portion of lining which is attached below it, in each case, and the flow cross-section limited by the lining 14 has a substantially smooth path.

The lining 14 is assembled in each case from an outer shell 15 with an insulating layer 16 and an inner shell 17, whereby an annular chamber 18 is formed between the outer shell 15 or the insulation layer 16 and the inner shell 17 by means of appropriate radial spacing of these parts. The outer shell 15 and the inner shell 17 in each case comprise acid-resistant and temperature-resistant brick material while the insulation 16 for example can be manufactured from fibre mats etc.

The annular chamber 18 is narrowed in the upper region of the lining 14 to form an annular gap 19 which is open at the upper end of the respective portion of the lining 14 so that air can get into the inner flow cross-section of the lining 14 in the transitional region to the next higher portion of the lining 14.

Openings 20 are provided in the conically broadening part of a portion of the lining 14 through which openings air can pass out of the lower region of the annular chamber 18 into the free chamber between the shaft 10 and the lining 14.

This free chamber is penetrated by a flow of cooling air which runs from an entry point 21 located at the base of the shaft 10 to outlets 22 located at the top of the shaft 10.

Connection openings 23 are distributed over the periphery of the lining 14 into which individual branches of a pipe system 24 open. In the example described here, there are three rise pipes 25 distributed over the periphery, branch lines 26 of which lead in each case horizontally to the connection openings 23. The branch lines 26 run at a height of approximately 2 m from the support plate 12 located thereunder.

Therefore surrounding air sucked in from the outside by a blower 27 is forced into the pipe system 24 whereby the air can be brought to a predetermined temperature in a heating device 28. A controller 29 serves to control the temperature, which, within the framework of this example, should always be 20° C. below the temperature of the flue gas in each case, and in each case a value for the instantaneous temperature and for the instantaneous pressure of the flow of flue gas are supplied to the controller 29 via measuring lines (not shown). These values serve as control parameters and as the basis for forming appropriate desired values according to which the controller predetermines pressure and temperature for the air to be conveyed into the pipe system 24. The actual values which are required for the functioning of the controller 29, can be tapped off at a suitable point in the pipe system 24 or in the annular chamber 18.

If the blower 27 is switched on, then an air pressure builds up in the annular gaps 19 which is greater than the pressure of the flow of flue gas. Thus the individual portions of the lining 14 are effectively sealed off. The loss of pressure caused by the annular gaps 19 is relatively small and only as large as is necessary for exchange of the compressed air located in the annular gaps 19 within a predetermined period of time.

In order not to restrict too greatly the cooling action of the flow of air penetrating the free area between the shaft 10 and the lining 14, it is advisable to keep the proportion of the compressed air passed out through the outlets 22 as low as possible.

The heating device 28 can be an electrical heating device for example. It is also conceivable however to withdraw the required quantity of heat from another heat-producing medium by means of a heat exchanger.

It will be understood that the above description of the present invention is susceptible to various modification, changes and adaptations.

What is claimed is:

1. A chimney comprising external shaft, an inner lining sub-divided into several portions arranged one above the other and each said portion including an outer shell and an inner shell defining an annular space therebetween, a support construction connected to the shaft for supporting said portions of said inner lining spaced from the shaft to define a free space between said shaft and said inner lining and air in said annular space between said outer shell and said inner shell at a higher pressure than the pressure of flue gas flowing up the chimney.

2. A chimney as defined in claim 1, and comprising means for causing a flow of compressed air to provide said air in said annular space between said outer and said inner shell.

3. A chimney as defined in claim 1, wherein the temperature of said air is not more than 30° C. different from the temperature of said flue gas.

4. A chimney as defined in claim 1, wherein the pressure of said air is approximately 2 mbar above the pressure of said flue gas.

5. A chimney as defined in claim 1, and comprising several connection openings for the supply of air in each said portion of said lining distributed over the periphery and of said portions opening into said annular space between said inner and outer shells.

6. A chimney as defined in claim 5 wherein said connecting openings which serve to supply the compressed air are situated at every portion of said lining at a height of approximately 1.5 to 2.5 m above said support construction retaining the respective portion of said lining.

7. A chimney as defined in claim 6 and comprising means by which a smaller part of said compressed air passes out at the underside of the respective portion of said lining and enters said free space between said shaft and said lining with the greater part of said compressed air passing out at the upper side of said portion of said lining and being introduced into said flow of said flue gas.

8. A chimney as defined in claim 5, and comprising three of said connection openings in each said portion of said lining.

9. A chimney as defined in claim 1 and comprising an outlet opening for said annular space between said inner and outer shells at at least one end thereof.

10. A chimney as defined in claim 9, wherein said outlet opening comprises of an annular clearance of a cross-section smaller than the cross-section of said annular space between said inner and outer shells.

11. A chimney as defined in claim 10, and comprising means for introducing compressed air passing out of said outlet opening into said flow of said flue gas.

12. A chimney as defined in claim 1 and comprising a pipe system for supply of said air, a blower connected at its outlet side to said pipe system with said pipe system and said blower designed to provide for a larger quantity of air than is necessary for the initial operating period of the chimney first operating period.

13. A chimney as defined in claim 12 and comprising a control circuit connected to said blower for automatically predetermining the quantity of air to be conveyed in dependence on the temperature and the pressure of said flow of said flue gas.

* * * * *